US006585254B2

(12) United States Patent
Hsieh

(10) Patent No.: US 6,585,254 B2
(45) Date of Patent: Jul. 1, 2003

(54) FEEDING DEVICE

(75) Inventor: Yen-Sung Hsieh, Taipei (TW)

(73) Assignee: Benq Corporation, Taoyuan (TW)

( * ) Notice: Subject to any disclaimer, the term of this patent is extended or adjusted under 35 U.S.C. 154(b) by 3 days.

(21) Appl. No.: 09/905,791

(22) Filed: Jul. 13, 2001

(65) Prior Publication Data

US 2002/0060402 A1 May 23, 2002

(30) Foreign Application Priority Data

Aug. 25, 2000 (TW) ..... 89117202 A

(51) Int. Cl.[7] ..... B65H 1/08

(52) U.S. Cl. ..... 271/127; 271/147; 271/157; 271/160

(58) Field of Search ..... 271/126, 127, 271/147, 157, 160; 414/796.8

(56) References Cited

U.S. PATENT DOCUMENTS

| | | | | | |
|---|---|---|---|---|---|
| 2,928,558 | A | * | 3/1960 | Bamford et al. | 108/147 |
| 3,843,115 | A | * | 10/1974 | Di Fulvio et al. | 271/157 |
| 4,078,788 | A | * | 3/1978 | Bellis et al. | 271/160 |
| 5,158,275 | A | * | 10/1992 | Sellers et al. | 271/126 |
| 5,228,677 | A | * | 7/1993 | Asakawa | 271/126 |
| 5,857,671 | A | | 1/1999 | Kato et al. | 271/10.11 |
| 5,893,556 | A | | 4/1999 | Akahane et al. | 271/126 |
| 5,954,327 | A | * | 9/1999 | Lin et al. | 271/126 |
| 6,123,329 | A | * | 9/2000 | Sato et al. | 271/145 |
| 6,250,500 | B1 | * | 6/2001 | Schweiberer | 271/126 |
| 6,254,084 | B1 | * | 7/2001 | Hellmer | 271/126 |

* cited by examiner

*Primary Examiner*—David H. Bollinger
(74) *Attorney, Agent, or Firm*—Ladas & Parry

(57) ABSTRACT

A pallet for supporting media such as papers is disposed on a parallel motion mechanism. As the media is loaded, the pallet is shifted from an initial site toward a predetermined site in parallel, and therefore the media supported by the pallet is sequentially scrubbed and transmitted to a printing device by a scrubbing device.

16 Claims, 10 Drawing Sheets

FEEDING DEVICE

BACKGROUND OF THE INVENTION

1. Field of the Invention

This invention relates to a feeding device. More particularly, this invention relates to a feeding device for supporting and moving media such as papers to a printing device.

2. Description of Prior Art

FIG. 1 is a plan view of a feeding device F1 disclosed by the FIG. 12 of U.S. Pat. No. 5,893,556. The feeding device F1 has a hopper table 1', springs 2' (2'), a pressure plate 3' and several rollers 5'. The pressure plate 3' is supported by the spaced springs 2' (2') which are disposed on the hopper table 1', and the rollers 5' are disposed on the pressure plate 3'. The stacked sheets S1' are put on the pressure plate 3' and scrubbed by the rollers 5'.

However, once the specification of the sheet S1' is medium size or smaller, such as envelope size, only one roller 5' can make contact with the media and only a small portion of the roller's surface may, in fact, contact the media. The pressure plate 3' easily becomes uneven due to the uneven contact with the rollers 5', and the sheets S1' may be stuck or jammed during the feeding process.

SUMMARY OF THE INVENTION

To solve the above problem, the primary object of this invention is to provide a feeding device for transmitting media such as paper to a printing device. The feeding device comprises a base, a reciprocating mechanism, a recovery device, a pallet and a scrubbing device. The reciprocating mechanism is a parallel motion mechanism disposed on the base and moved between an initial site and a predetermined site. The recovery device is disposed on the reciprocating mechanism and intended to move the reciprocating mechanism toward the initial site. The pallet is disposed on the reciprocating mechanism and used for supporting the media. The scrubbing device is disposed on the pallet and used for moving the media.

As the media is loaded, the pallet is shifted from an initial site toward a predetermined site in parallel, and thus the media supported by the pallet is sequentially transmitted to the printing device by the scrubbing device.

BRIEF DESCRIPTION OF THE DRAWINGS

The present invention can be more fully understood by reading the subsequent detailed description and examples with reference made to accompanying drawings in which.

DETAILED DESCRIPTION OF THE PREFERRED EMBODIMENTS

First Embodiment

Figure 1:
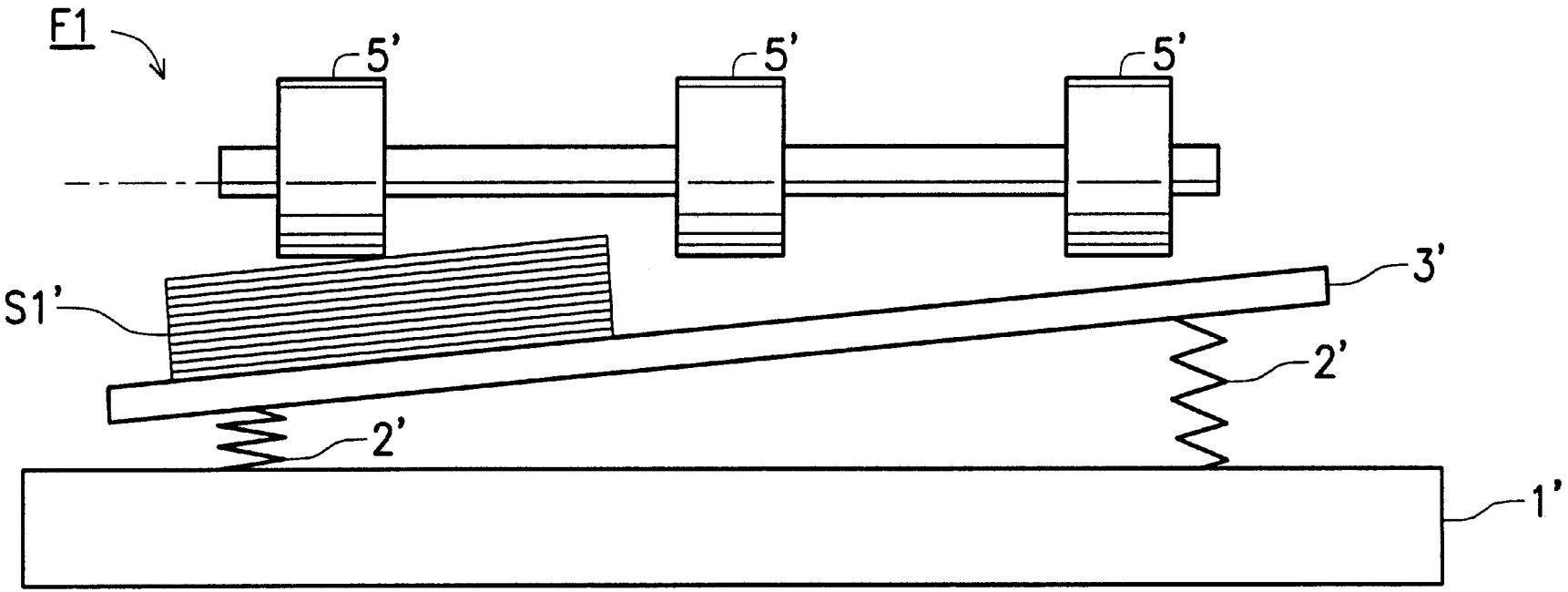
FIG. 1 (PRIOR ART)
FIG. 1 is a plan view of a feeding device (F) disclosed by U.S. Pat. No. 5,893,556.
Figure 2A:
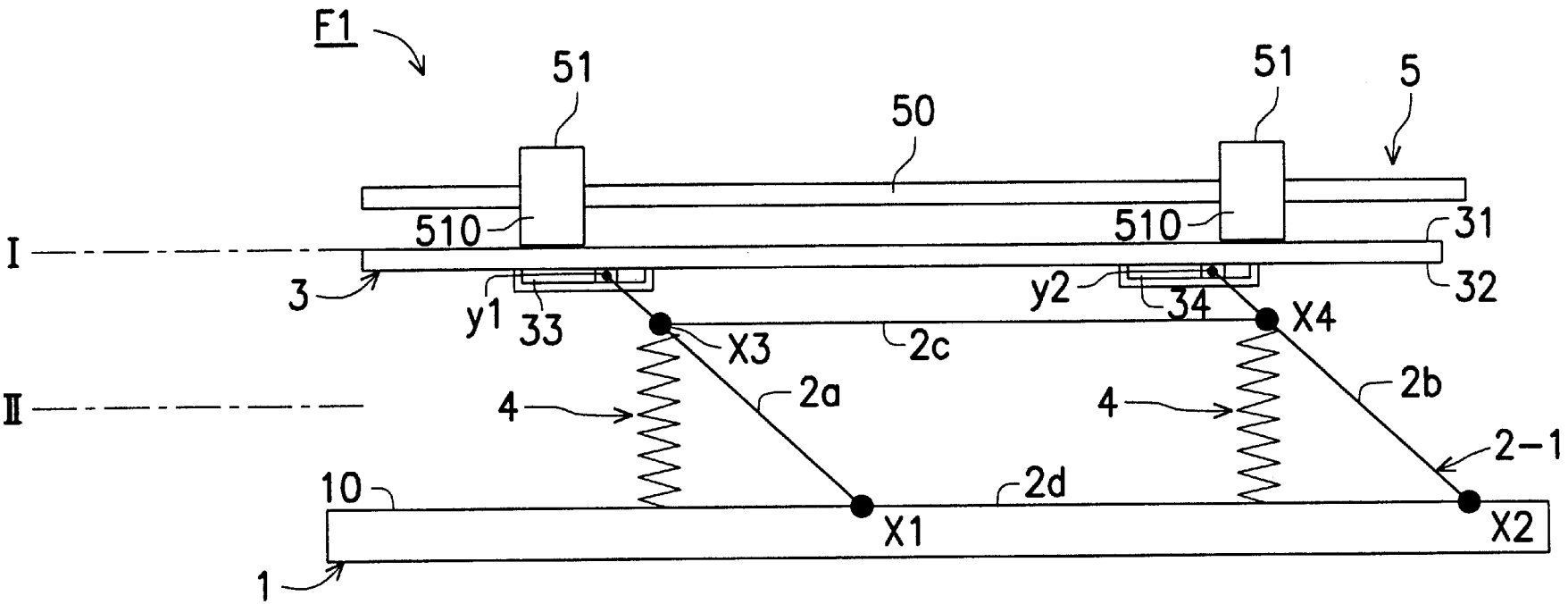
FIG. 2A is a plan view showing a feeding device (F1) according to a first embodiment of the present invention.

Referring to FIG. 2A, a feeding device F1 is an apparatus for supporting and moving media such as papers to a printing device (not shown). The feeding device F1 comprises a base 1, a reciprocating mechanism 2-1 disposed on a surface 10 of the base 1, a pallet 3 disposed on the reciprocating mechanism 2-1, a recovery device 4 disposed on the reciprocating mechanism 2-1, and a scrubbing device 5 disposed on the pallet 3.

The reciprocating mechanism 2-1, a parallel motion mechanism moving between an initial site I and a predetermined site II, comprises a four-bar linkage and two sliders y1, y2. The four-bar linkage has four bars 2*a*, 2*b*, 2*c* and 2*d*, wherein the bar 2*d*, which is preferred the base 1, is a fixed element of the reciprocating mechanism 2-1, and the bars 2*a*, 2*b*, 2*c* and the sliders y1, y2 are all movable elements constructed on the bar 2*d*. The bars 2*a*, 2*b* are pivotally connected to the base 1 at two fixed centers X1, X2, respectively. Both ends of the bar 2*c* are pivotally connected to the bars 2*a*, 2*b* at two instantaneous centers X3, X4, respectively. The sliders y1, y2 are disposed on the free end of the bars 2*a*, 2*b*, respectively.

The base 1 here can be actually considered as the fixed element (bar 2*d*) of the reciprocating mechanism 2-1, i.e., the base 1 is equal to the bar 2*d* of the reciprocating mechanism 2-1.

The pallet 3 is a plate provided with an upper surface 31 and a lower surface 32. Two spaced guiding paths 33, 34 are formed on the lower surface 32 of the pallet 3, and the sliders y1, y2 are received in the guiding paths 33, 34, respectively.

The recovery device 4 is a resilient element such as springs or the like disposed between the reciprocating mechanism 21 and the base 1. In this embodiment, two recovery devices 4, 4 are connected to the instantaneous centers X3, X4 of the reciprocating mechanism 2-1 and contacting the base 1, respectively. The scrubbing device 5 has a shaft 50 and two rollers 51, 51, and each of the rollers 51, 51 is provided with a scrubbing surface 51. The spaced rollers 51, 51 are mounted on the shaft 50 and disposed onto the pallet 3. With the two recovery devices 4, 4, the pallet 3 mounted on the reciprocating mechanism 2-1 is initially kept at the site I, and the pallet 3 can be moved to the site II as the recovery devices 4 are fully compressed. The pallet 3 has a tendency to be moved back to the initial site I as the recovery devices 4 are compressed.

Figure 2B:
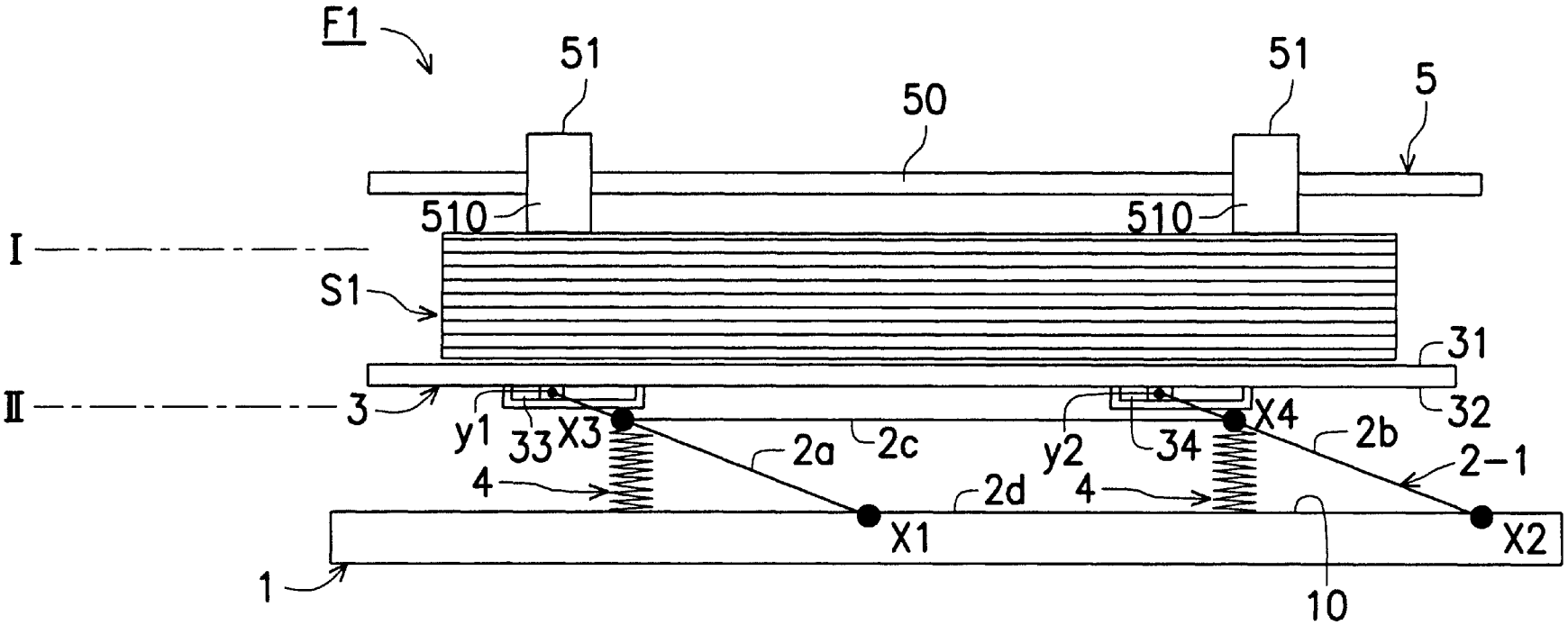
FIG. 2B is a plan view of the feeding device (F1) loaded with a stack of full-sized media (S1) according to FIG. 2A.
Figure 2C:
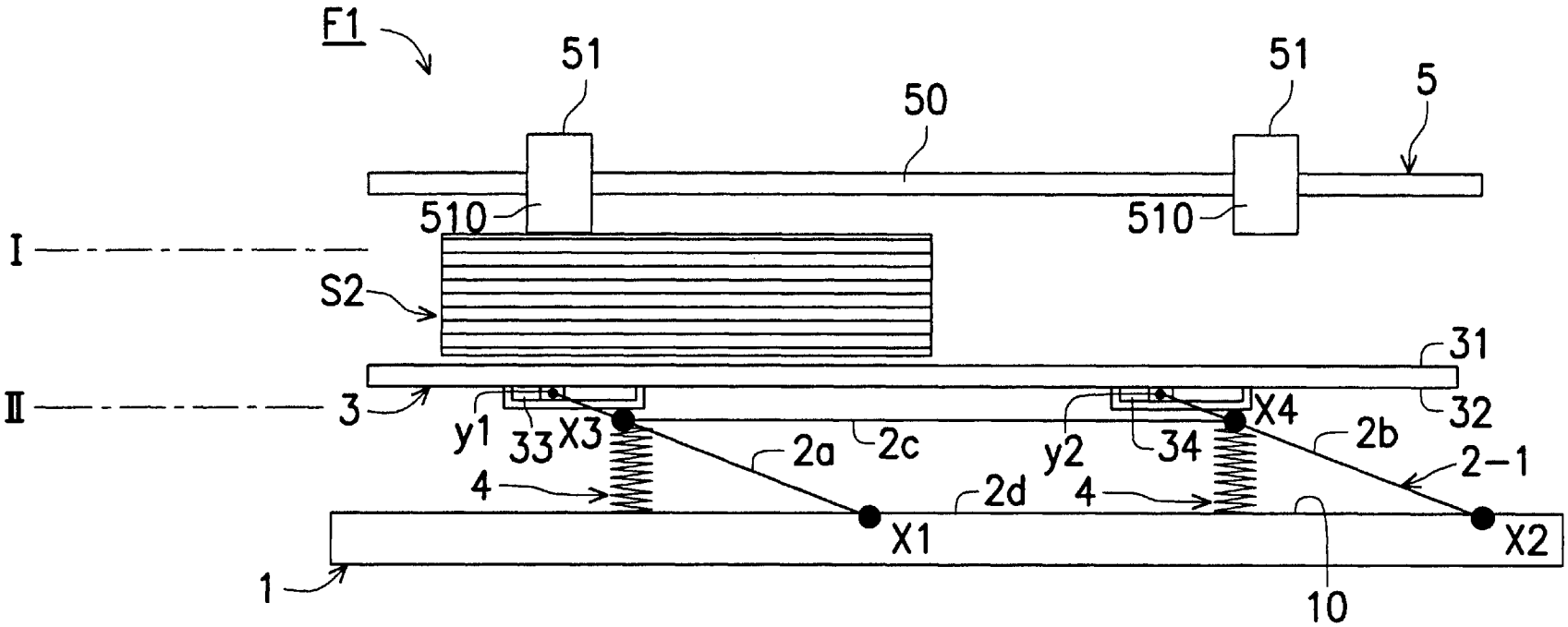
FIG. 2C is a plan view of the feeding device (F1) loaded with a stack of medium-sized media (S1) according to FIG. 2A.

In FIG. 2B and FIG. 2C, the feeding device F1 is loaded with a stack of full-sized and medium media S1, respectively. As the media S1 is disposed on the pallet 3 by the press of the rollers 51, 51 of the scrubbing device 5, the bars 2*a*, 2*b* are synchronically rotated about the two fixed centers X1, X2 in a counterclockwise direction. The recovery devices 4, 4 are compressed between the reciprocating mechanism 2-1 and the base 1. The pallet 3 is horizontally shifted from the site I toward the site II by sliding the sliders y1, y2 along the guiding paths 33, 34. The media S1 is then sequentially transmitted to the next equipment or device such as printer by the actuated rollers 51, 51. As the amount of the media S1 is gradually reduced, the top of the media S1 can still make effective contact with the two rollers 51, 51 (FIG. 2B) or one of them (FIG. 2C) by the force generated by the compressed recovery devices 4.

Second Embodiment

Figure 3A:
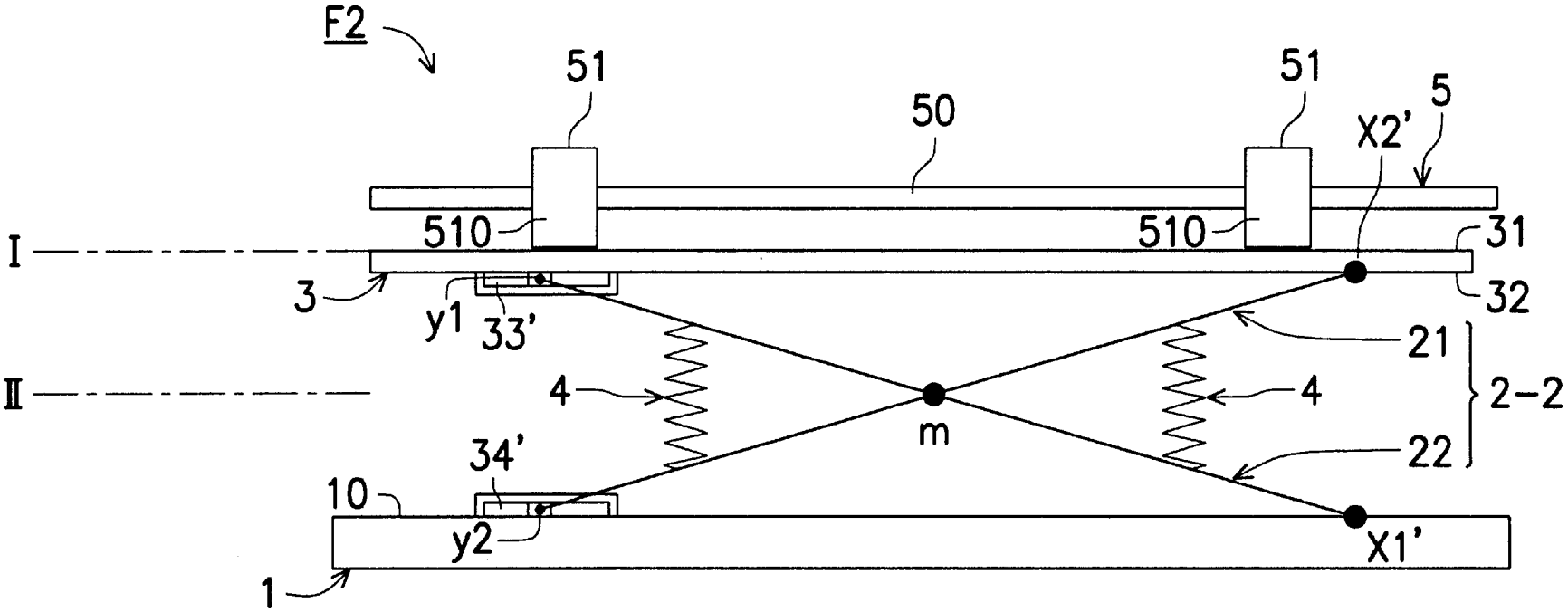
FIG. 3A is a plan view showing a feeding device (F2) according to a second embodiment of the present invention.
Figure 3B:
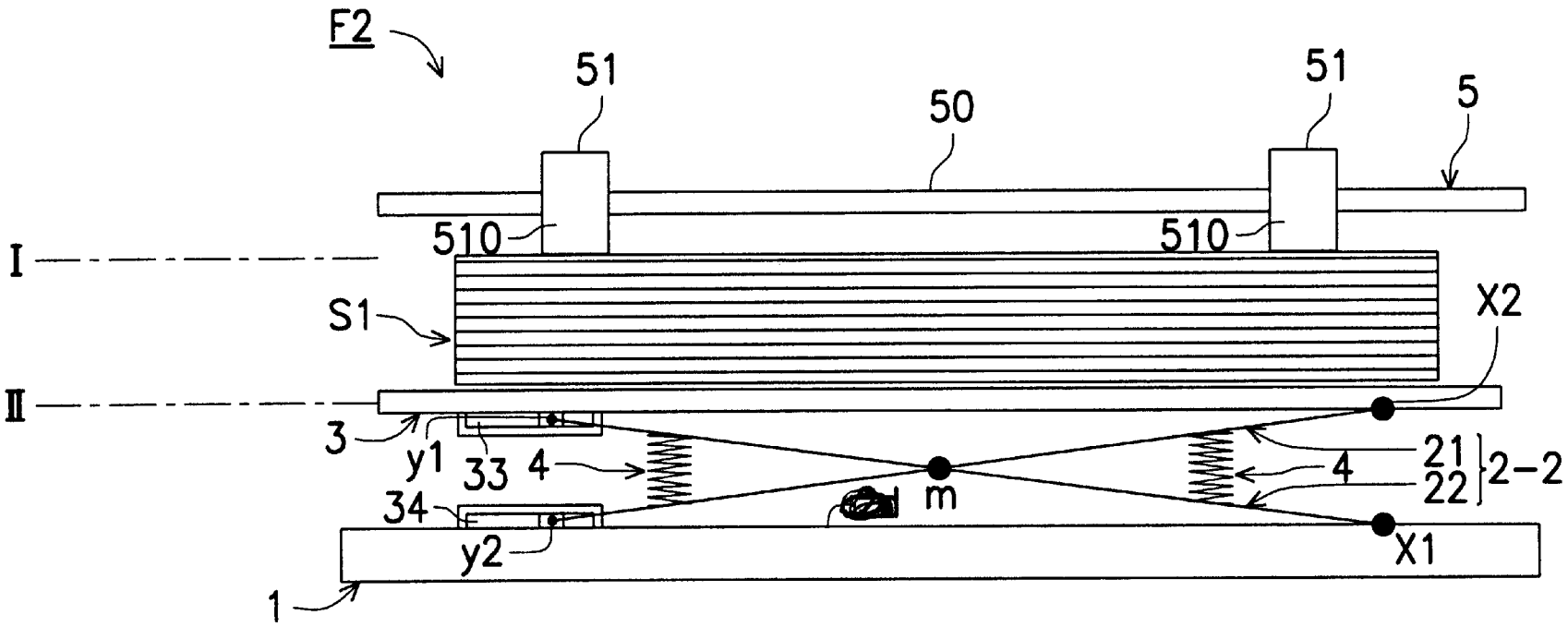
FIG. 3B is a plan view of the feeding device (F2) loaded with a stack of full-sized media (S1) according to FIG. 3A.

In FIGS. 3A to 3B, a feeding device F2 is provided with a reciprocating mechanism 2—2 having a structure different from the one of the above reciprocating mechanism 2-1, and two guiding paths 33', 34' are respectively formed on the pallet 3 and the base 1, respectively.

The reciprocating mechanism 2—2 is also a parallel motion mechanism comprising a scissors-like linkage and two sliders y1, y2. The scissors-like linkage is composed of two bars 21, 22, which are crossed and connected to each other at an instantaneous center "m". One end of the bar 22 is pivotally connected to the base 1 at fixed centers X1' and one end of the bar 21 is pivotally connected to the base 1 at an instantaneous center X2' located at the pallet 3. The sliders y1, y2 are respectively mounted on another end of each bar 21, 22, and also the sliders y1, y2 are respectively received in the guiding paths 33', 34'. Two recovery devices 4, 4 are respectively disposed between the bars 21, 22 symmetrically divided by the instantaneous center "m".

Figure 3C:
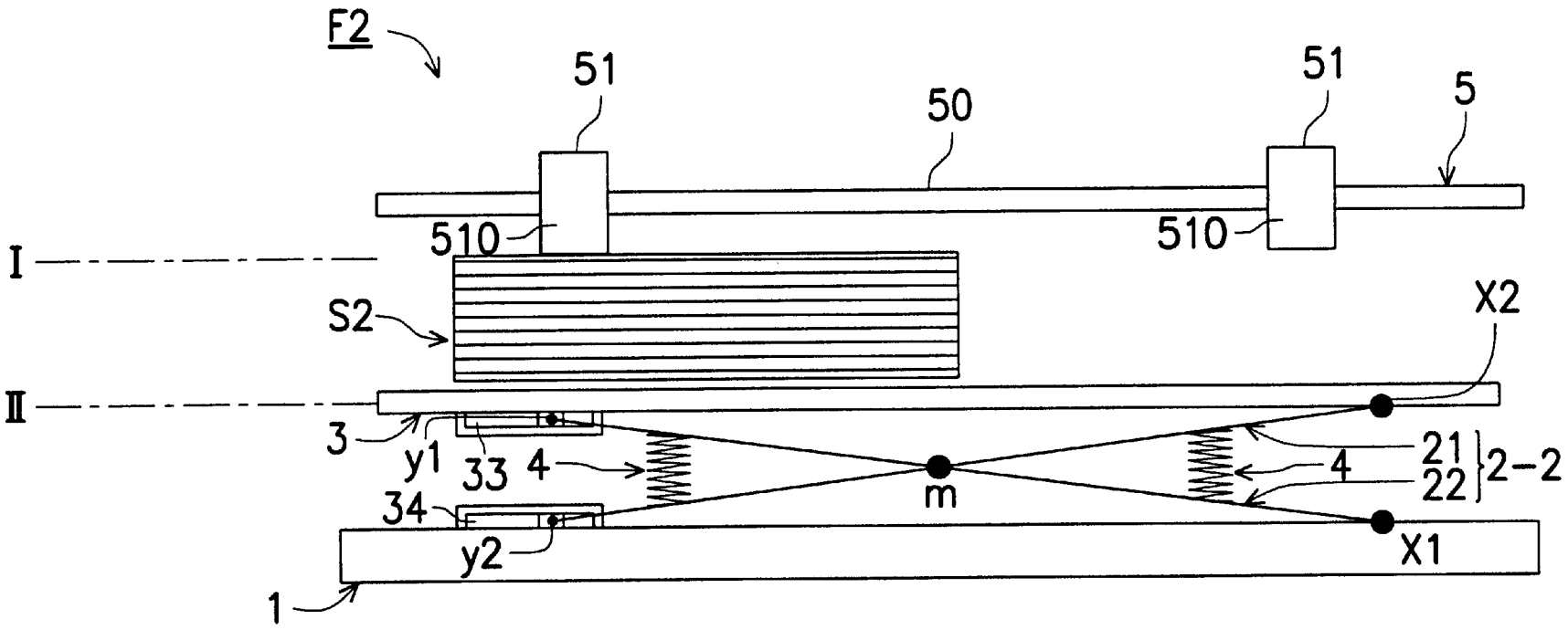
FIG. 3C is a plan view of the feeding device (F2) loaded with a stack of medium-sized media (S1) according to FIG. 3A.

As the different sizes of media S1 shown in FIG. 3B and FIG. 3C are loaded, the pallet 3 is shifted in a downward direction from the site I toward the site II. Then, the sliders y1, y2 are moved along the guiding paths 33', 34', and the recovery devices 4, 4 are respectively and uniformly compressed by the approaching bars 21, 22 which are rotated about the instantaneous center "m".

Third Embodiment

Figure 4A:
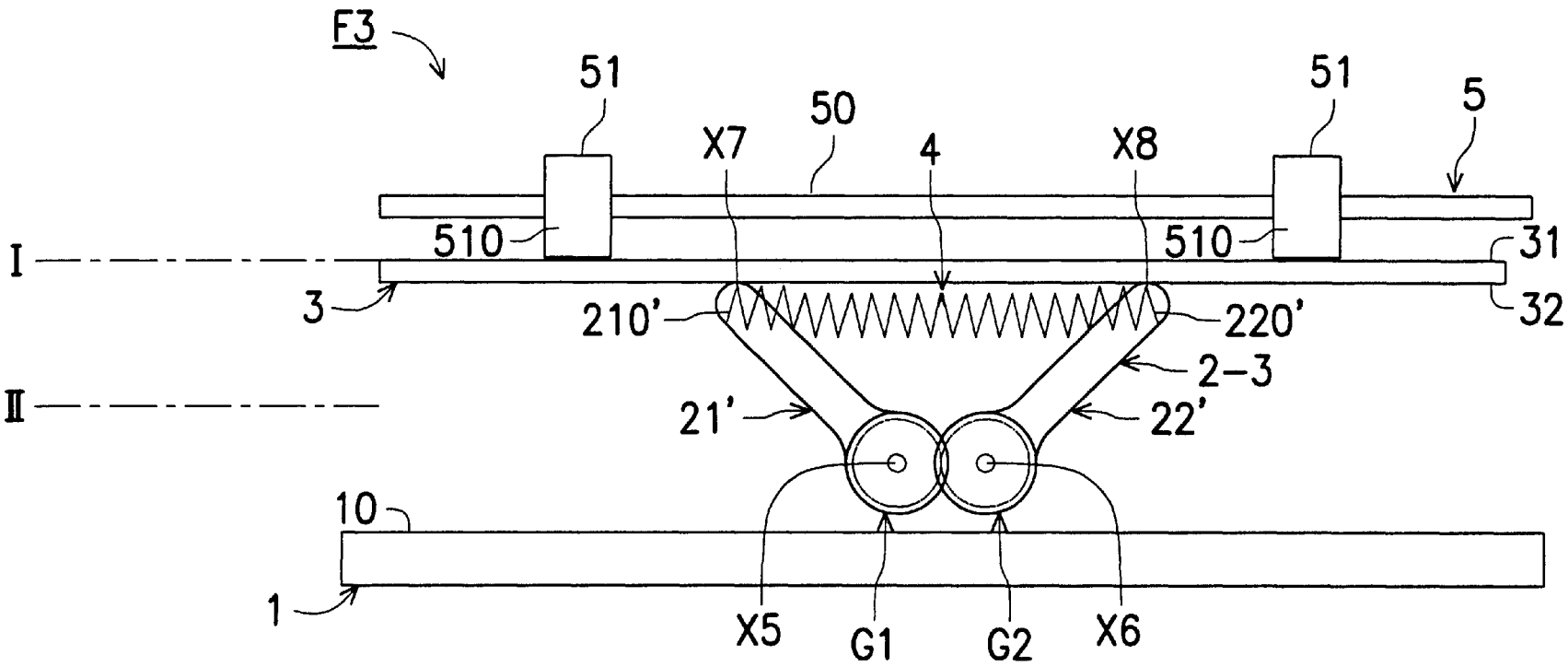
FIG. 4A is a plan view showing a feeding device (F3) according to a third embodiment of the present invention.
Figure 4B:
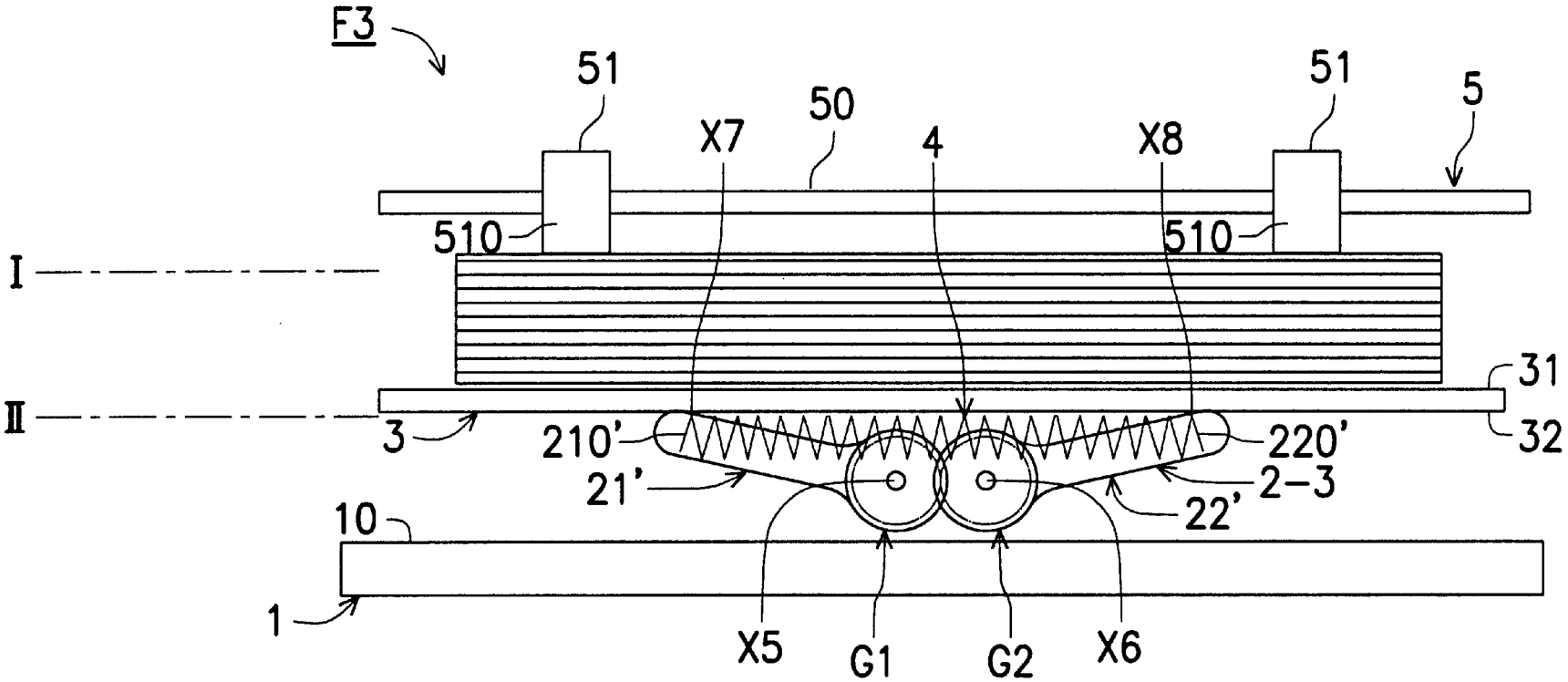
FIG. 4B is a plan view of the feeding device (F3) loaded with a stack of full-sized media (S1) according to FIG. 4A.

In FIGS. 4A to 4B, the third embodiment differs from the previous two embodiments in that a reciprocating mechanism 2-3 of a feeding device F3 is mainly constructed by a gear set, without the use of linkage or the like. All other elements such as the base 1, the pallet 3 and the scrubbing device 5 of the feeding device F3 have the same structure and corresponding reference numerals as the previous two embodiments.

The reciprocating mechanism 2-3 comprises a first portion 21' and a second portion 22' which are rotated about two fixed centers X5, X6, respectively. The first portion 21' has a first gear G1 and a first extension 210', and the second portion 22' has a second gear G2 engaged with first gear G1 and a second extension 220' connected to the first extension 210' with a recovery device 4. The free end of the first extension 210' and the free end of the second extension 220' contact the lower surface 32 of the pallet 3 at two instantaneous centers X7, X8, respectively.

Figure 4C:
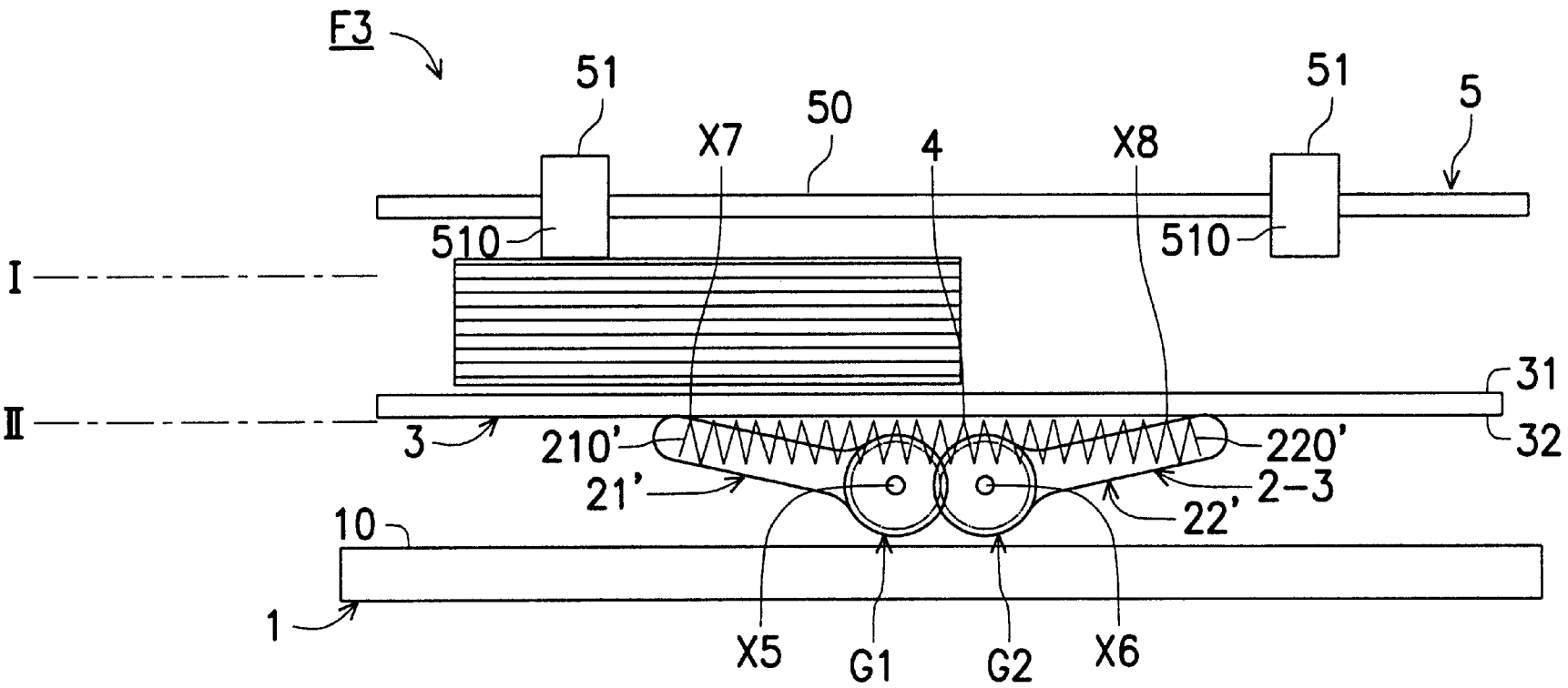
FIG. 4C is a plan view of the feeding device (F3) loaded with a stack of medium-sized media (S1) according to FIG. 4A.

As the media S1 in FIG. 4B and FIG. 4C are loaded, the pallet 3 is shifted downward from the site I toward the site II, and the first portion 21' and the second portion 22' are forcibly rotated about the fixed centers X5, X6 with symmetrically. The first extension 210' and the second extension 220' slide away from each other on the surface 32 of the pallet 3 and the recovery device 4 is tensed.

Further, a magnetic device can replace the recovery devices 4 mentioned above. The magnetic forces generated by the magnetic device can be used to limit the reciprocating mechanism moving between two designed sites, and the magnetic forces can be controlled to move the reciprocating mechanism back to the initial site as the reciprocating mechanism is moved.

Based on the description of each embodiment, the pallet 3 is precisely moved between the site I and the site II in parallel, and therefore the media S1 placed on the pallet 3 is sequentially transmitted by the roller 51 of the scrubbing device 5 to the printing device.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for supporting a media, comprising:

a reciprocating mechanism;

a pallet disposed on the reciprocating mechanism, moved between an initial site and a predetermined site and used for supporting the media; and a recovery device disposed on the reciprocating mechanism and intended to move the pallet toward the initial site, wherein the reciprocating mechanism comprises a first portion constructed by a first gear and a first extension and a second portion constructed by a second gear engaged with the first gear and a second extension connected to the first extension with the recovery device.

2. The apparatus as claimed in claim 1, further comprising a scrubbing device disposed on the pallet and used for moving the media.

3. The apparatus as claimed in claim 1, wherein the reciprocating mechanism is a parallel motion mechanism.

4. The apparatus as claimed in claim 1, wherein the reciprocating mechanism comprises a linkage and at least one slider connected to the pallet.

5. The apparatus as claimed in claim 1, wherein the recovery device is made of resilient element.

6. The apparatus as claimed in claim 1, wherein the recovery device is a spring.

7. The apparatus as claimed in claim 1, wherein the media are papers.

8. An apparatus for supporting a media, comprising:

a base;

a reciprocating mechanism disposed on the base, having a first portion and a second portion which are engaged to each other;

a pallet disposed on the reciprocating mechanism, moved between an initial site and a predetermined site and used for supporting the media; and a recovery device disposed between the first portion and the second portion and intended to move the pallet toward the initial site, wherein the reciprocating mechanism comprises a first portion constructed by a first gear and a first extension and a second portion constructed by a second gear engaged with the first gear and a second extension connected to the first extension with the recovery device.

9. The apparatus as claimed in claim 8, further comprising a scrubbing device disposed on the pallet and used for moving the media.

10. The apparatus as claimed in claim 8, wherein the reciprocating mechanism is a parallel motion mechanism.

11. The apparatus as claimed in claim 8, wherein the reciprocating mechanism comprises a linkage and at least one slider connected to the base.

12. The apparatus as claimed in claim 8, wherein the recovery device is made of a resilient element.

13. The apparatus as claimed in claim 8, wherein the recovery device is a spring.

14. The apparatus as claimed in claim 8, wherein the media are papers.

15. An apparatus for supporting a media, comprising:

a reciprocating mechanism, the reciprocating mechanism comprising:

a base;

a first bar, the lower end of the first bar pivotally connected to the base;

a second bar, the lower end of the second bar pivotally connected to the base; and a third bar, the first end of the third bar pivotally connected to the first bar, and the second end of the third bar pivotally connected to the second bar;

a pallet disposed on the reciprocating mechanism, moved between a first position and a second position; and a recovery device disposed on the reciprocating mechanism and intended to move the pallet toward the first position.

16. The apparatus as claimed in claim 15, the reciprocating mechanism further comprising two sliders disposed on the upper ends of the first bar and the second bar respectively, and the pallet further comprising two guiding paths for slidably receiving the two sliders respectively; wherein when the pallet moves between the first position and the second position, the two sliders slide toward the same direction within the guiding paths.

* * * * *